United States Patent [19]

Yamashita

[11] Patent Number: 4,571,369

[45] Date of Patent: Feb. 18, 1986

[54] PHOTOCONDUCTIVE FILM AND ELECTROPHOTOGRAPHIC PHOTOSENSITIVE MEMBER USING SAID FILM COMPRISING SILYLATED AZO PIGMENT

[75] Inventor: Masataka Yamashita, Kiyose, Japan

[73] Assignee: Canon Kabushiki Kaisha, Tokyo, Japan

[21] Appl. No.: 600,333

[22] Filed: Apr. 13, 1984

[30] Foreign Application Priority Data

Apr. 20, 1983 [JP] Japan ..... 58-68361

[51] Int. Cl.[4] ..... G03G 5/06

[52] U.S. Cl. ..... 430/56; 430/72; 430/76; 430/78; 430/106; 106/288 Q; 430/58

[58] Field of Search ..... 430/58, 72, 76, 77, 430/78

[56] References Cited

U.S. PATENT DOCUMENTS

| | | | |
|---|---|---|---|
| 4,043,929 | 8/1977 | Gibson et al. | 430/904 X |
| 4,123,270 | 10/1978 | Heil et al. . | |
| 4,247,614 | 1/1981 | Ohta et al. | 430/79 |
| 4,251,613 | 2/1981 | Sasaki et al. | 430/75 |
| 4,251,614 | 2/1981 | Sasaki et al. | 430/79 |
| 4,256,821 | 3/1981 | Enomoto et al. | 430/59 |
| 4,268,547 | 5/1981 | Backhouse | 427/385.5 |
| 4,268,596 | 5/1981 | Sasaki et al. | 430/72 |
| 4,293,628 | 10/1981 | Hashimoto et al. | 430/58 |

OTHER PUBLICATIONS

A. Pierce, Silylation of Organic Compounds, Pierce Chemical (1969), QD281.S5P5, pp. 2–5.

*Primary Examiner*—John D. Welsh

*Attorney, Agent, or Firm*—Fitzpatrick, Cella, Harper & Scinto

[57] ABSTRACT

Photoconductive film having a photoconductive pigment obtained by silylation of pigment having at least one hydroxy group, and electrophotographic photosensitive member making use thereof.

20 Claims, No Drawings

PHOTOCONDUCTIVE FILM AND ELECTROPHOTOGRAPHIC PHOTOSENSITIVE MEMBER USING SAID FILM COMPRISING SILYLATED AZO PIGMENT

BACKGROUND OF THE INVENTION

1. Field of the Invention

This invention relates to a photoconductive film and an electrophotographic photosensitive member using the film, and more particularly, to an electrophotographic photosensitive member where the increase in residual potential upon repeated use is prevented.

2. Description of the Prior Art

There are known electrophotographic photosensitive members of a laminate type which comprises a conductive support, a charge generation layer principally comprising a charge generation material such as selenium, cadmium sulfide, phthalocyanine pigment, azo pigment, indigo dye, perylene series pigment, and the like and, further thereon, and a charge transfer layer principally comprising a charge transfer material such as poly-N-vinylcarbazole, phenanthrene, and the like.

Since, in particular, organic pigments and dyes as charge generation materials are easier to synthesize in comparison with inorganic materials and moreover the selectivity of the photosensitive wavelength region has been enlarged and so on, a number of organic pigments and dyes are charge generation materials have been proposed.

For instance, the laminate type electrophotographic photosensitive members using disazo pigment as disclosed in the specifications of U.S. Pat. Nos. 4,123,270, 4,247,614, 4,251,613, 4,251,614, 4,256,821, 4,260,672, 4,268,596, 4,268,547, 4,293,628, etc. are known. However, there are disadvantages that when a photosensitive member of such a multilayer construction is used repeatedly, residual electric charges are accumulated due to charge injection in the interface between the charge generation layer and the charge transfer layer, or trap in the charge generation layer resulting in low sensitivity, low resolution and fog of copy image. Therefore, in order to prevent these disadvantages, such technologies as minimizing the thickness of a charge generation layer or adding various additives to the charge generation and charge transfer layers and so on have hitherto been proposed. Even by these methods, however, the accumulation of residual electric charge is large in the laminate type photosensitive member.

SUMMARY OF THE INVENTION

An object of this invention is to provide an electrophotographic photosensitive member that has solved the disadvantages as mentioned above.

Another object of this invention is to provide an electrophotographic photosensitive member capable of reducing the accumulation of residual electric charges on repeated use.

A further object of this invention is to provide a highly sensitive electrophotographic photosensitive member where the trap within the charge generation layer is reduced.

A further object of this invention is to provide an organic photoconductive member excellent in dispersibility.

According to one aspect of the present invention, there is provided a photoconductive pigment obtained by silylation of a pigment having at least one hydroxy group.

According to another aspect of the present invention, there is provided an electrophotographic photosensitive member which comprises a conductive substrate and a photosensitive layer containing photoconductive pigment obtained by silylation of pigment having at least one hydroxy group.

According to a further aspect of the present invention, there is provided an electrophotographic photosensitive member which comprises a conductive substrate, a charge generation layer containing photoconductive pigment obtained by silylation of pigment having at least one hydroxy group, and a charge transfer layer.

DETAILED DESCRIPTION OF THE PREFERRED EMBODIMENTS

As the pigments to be used for silylation treatment according to this invention, there may be used pigments having at least one hydroxy group or preferably, a phenolic hydroxy group.

In a preferable embodiment of this invention, azo series pigments (disazo series pigments, trisazo series pigments) having a coupler component with a phenolic hydroxy group can be employed. As the coupler component having a phenolic hydroxy group, the hydroxy naphthoic acid amide type coupler component as expressed in the following general formula (1), the hydroxy naphthalic acid imide type coupler component as expressed in the following general formula (2) or (3), or the amino naphthol type coupler component is preferable.

General formulas

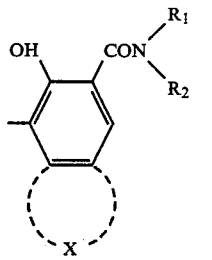

(1)

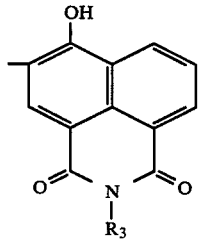

(2)

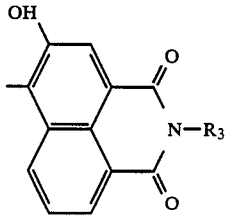

(3)

-continued

General formulas (4)

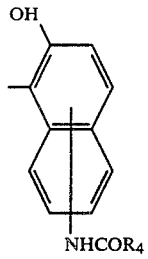

where $R_1$ is hydrogen atom, substituted or unsubstituted alkyl group such as methyl, ethyl, propyl, butyl, amyl, hydroxymethyl, chloromethyl, 2-hydroxyethyl, 2-methoxyethyl, 2-ethoxyethyl, 3-hydroxypropyl, 2-chloroethyl, 3-chloropropyl and the like, substituted or unsubstituted aryl such as phenyl, tolyl, xylyl, naphthyl, methoxyphenyl, dimethoxyphenyl, trimethoxyphenyl, chlorophenyl, dichlorophenyl, nitrophenyl, aminophenyl, methoxychlorophenyl and the like, or substituted or unsubstituted aralkyl group such as benzyl, phenethyl, naphthylmethyl, methoxybenzyl, ethoxybenzyl and the like, $R_2$ is alkyl such as methyl, ethyl, propyl, butyl, amyl, hydroxymethyl, chloromethyl, 2-hydroxyethyl, 2-methoxyethyl, 2-ethoxyethyl, 3-hydroxypropyl, 2-chloroethyl, 3-chloropropyl and the like, aryl group such as phenyl, tolyl, xylyl, naphthyl, methoxyphenyl, dimethoxyphenyl, trimethoxyphenyl, chlorophenyl, dichlorophenyl, nitrophenyl, aminophenyl, methoxychlorophenyl and the like, aralkyl group such as benzyl, phenethyl, naphthylmethyl, methoxybenzyl, ethoxybenzyl and the like or heterocyclic group such as carbazolyl, furyl, dibenzofuryl and the like, that may be substituted, respectively. X is an atomic group required to form aromatic hydrocarbon ring such as naphthalene, anthracene, and the like, or heterocyclic ring such as carbazole, dibenzofuran, benzcarbazole and the like by condensation with benzene ring.

$R_3$ and $R_4$ represent alkyl group such as methyl, ethyl, propyl, butyl, amyl, hydroxymethyl, chloromethyl, 2-hydroxyethyl, 2-methoxyethyl, 2-ethoxyethyl, 3-hydroxypropyl, 2-chloroethyl, 3-chloropropyl and the like, aryl group such as phenyl, tolyl, xylyl, naphthyl, methoxyphenyl, dimethoxyphenyl, trimethoxyphenyl, chlorophenyl, dichlorophenyl, nitrophenyl, aminophenyl, methoxychlorophenyl and the like, or aralkyl group such as benzyl, phenethyl, naphthyl methyl, methoxybenzyl, ethoxybenzyl, chlorobenzyl and the like, which may be substituted, respectively.

Disazo pigment before silylation treatment as employed in this invention can be synthesized simply by tetrazolating a diamine under a conventional process, followed by coupling of the corresponding coupler having OH radical in the presence of alkali, or by first isolating the tetrazonium salt of the aforesaid diamine with fluoborate or zinc chloride double salt, etc. and then coupling with a coupler having OH radical in an appropriate solvent such as N,N-dimethyl formamide, dimethyl sulfoxide, and the like in the presence of alkali. On the other hand, trisazo pigments can be obtained by using triamine.

As typical disazo pigments before silylation treatment to be used in this invention, the following disazo pigments may be given.

(1)

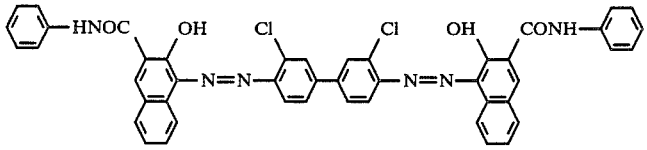

(2)

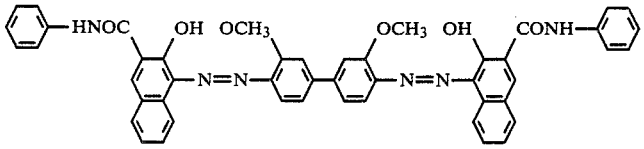

(3)

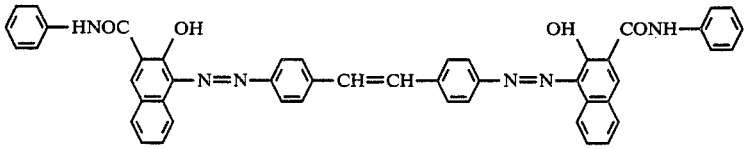

(4)

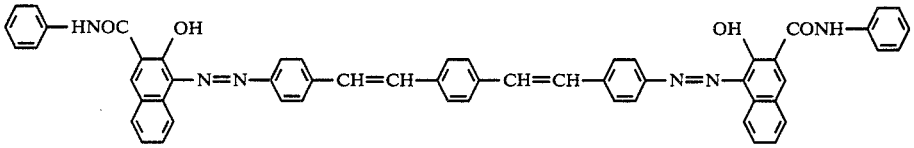

-continued
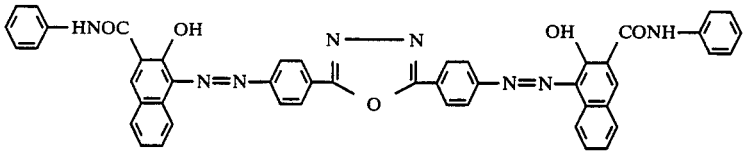
(5)
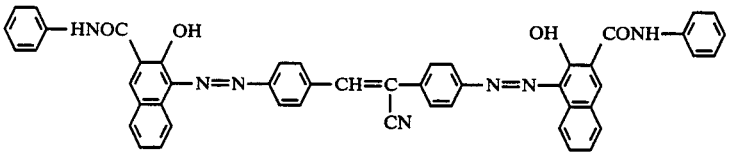
(6)
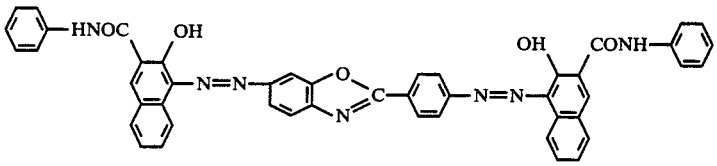
(7)
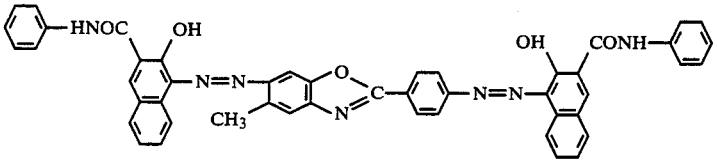
(8)
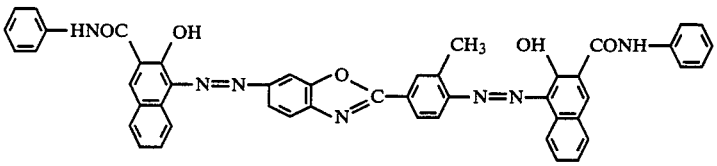
(9)
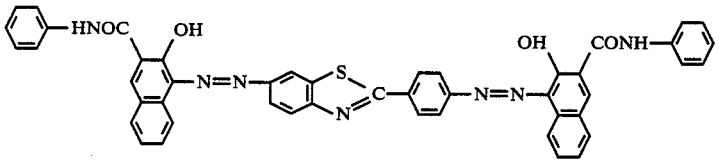
(10)
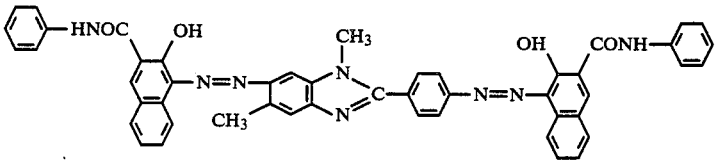
(11)
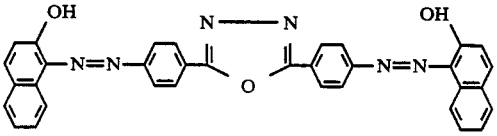
(12)
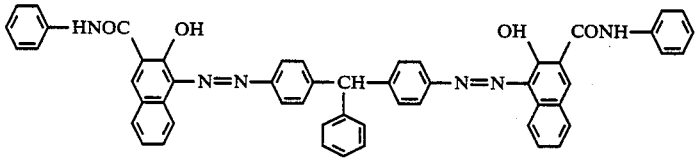
(13)

-continued
(14)
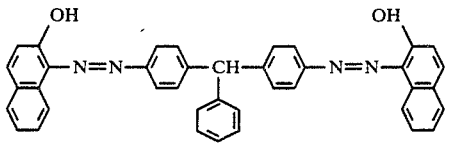
(15)
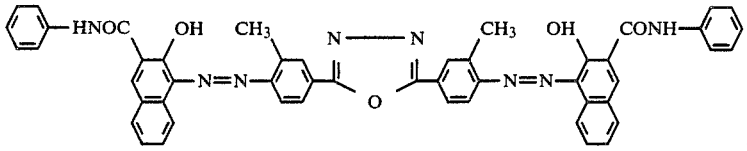
(16)
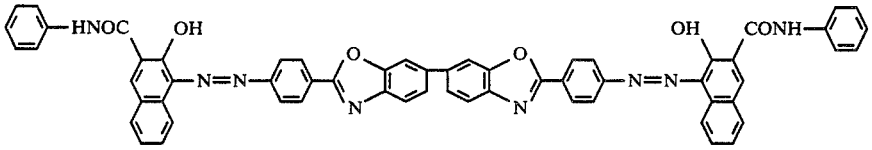
(17)
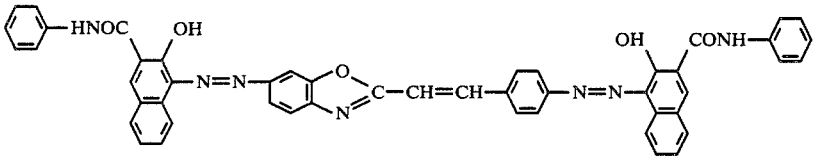
(18)
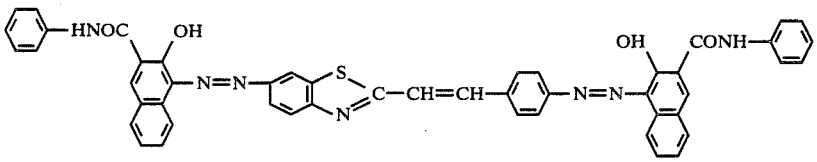
(19)
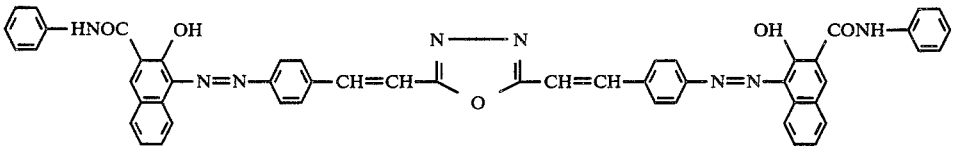
(20)
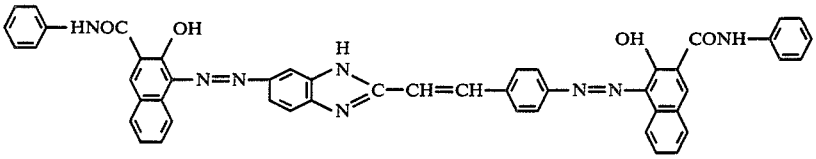
(21)
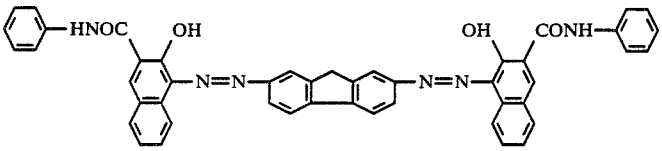
(22)
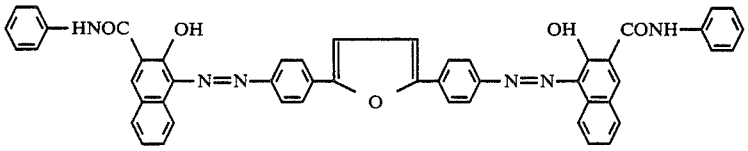

-continued
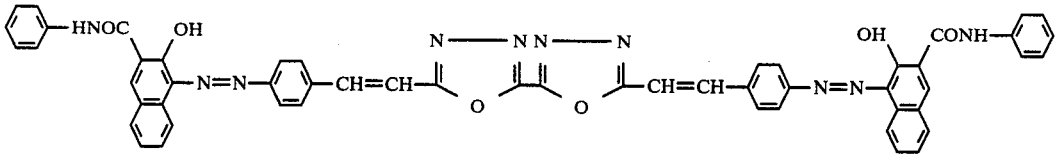
(23)
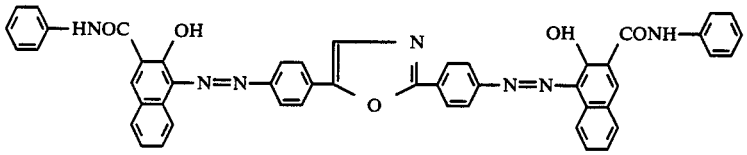
(24)
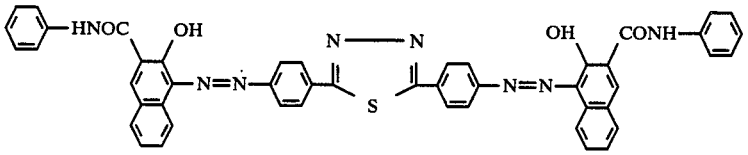
(25)
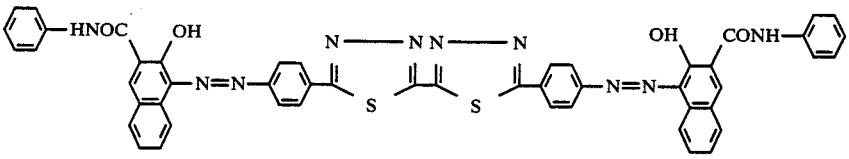
(26)
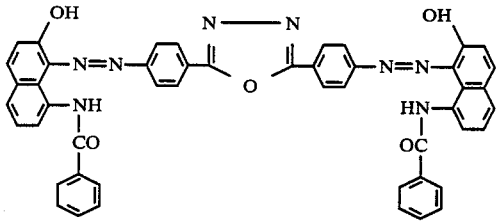
(27)
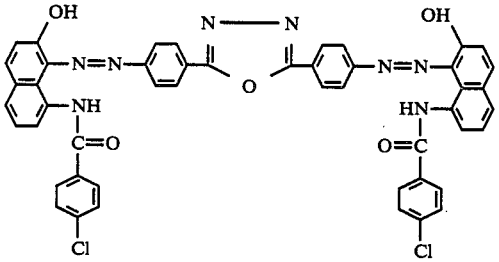
(28)
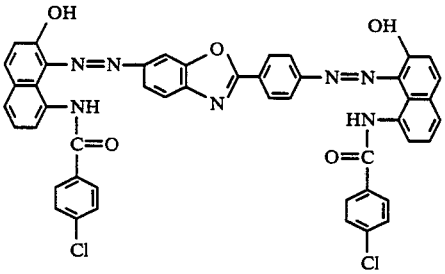
(29)

-continued
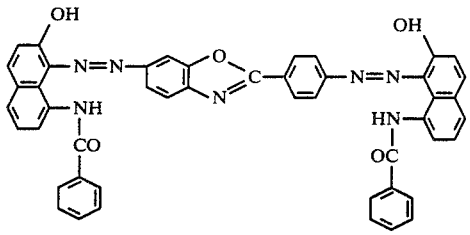
(30)
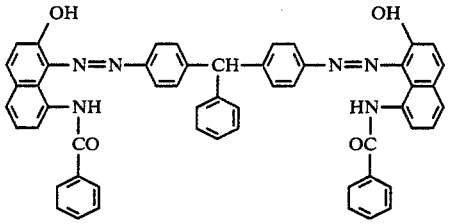
(31)
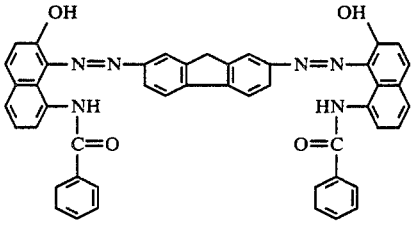
(32)
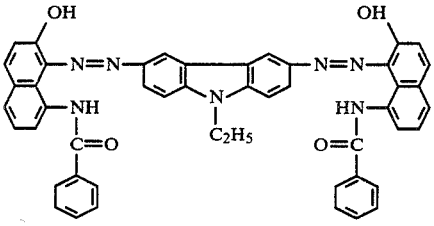
(33)
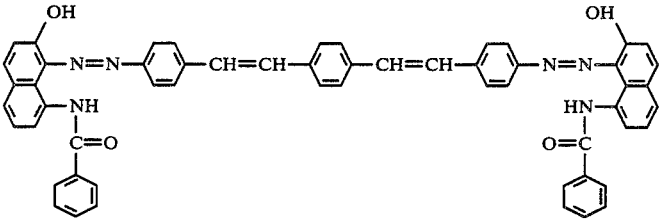
(34)
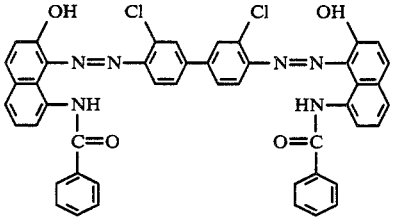
(35)
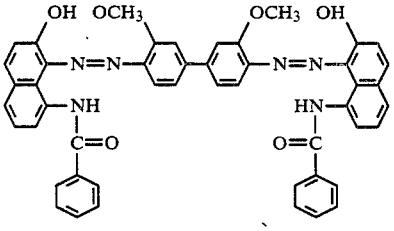
(36)

-continued
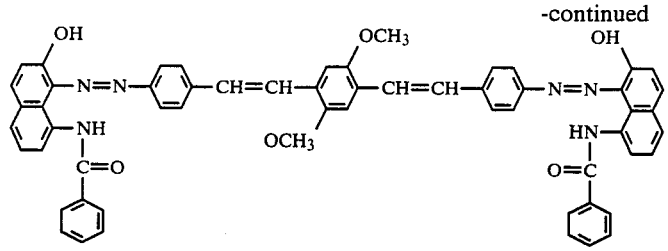
(37)
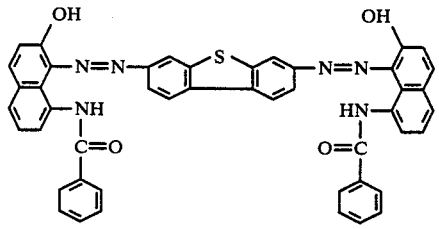
(38)
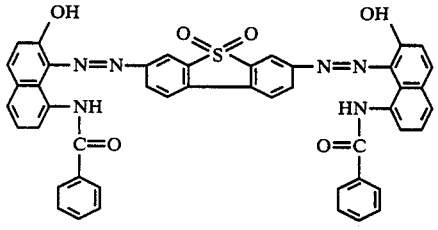
(39)
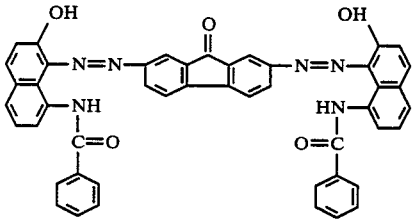
(40)
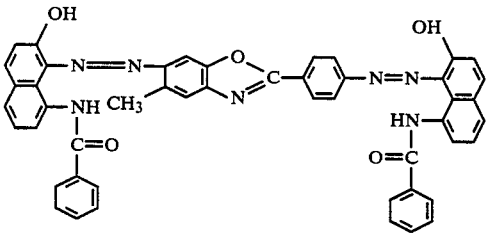
(41)
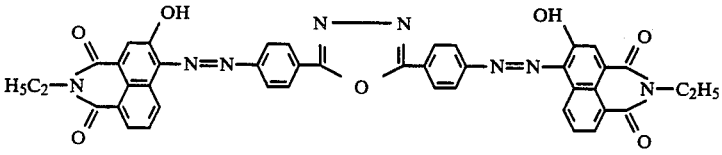
(42)
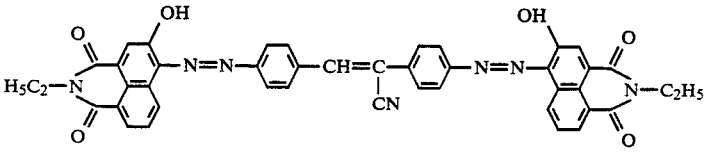
(43)
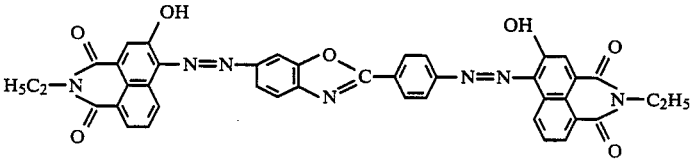
(44)

-continued
(45)
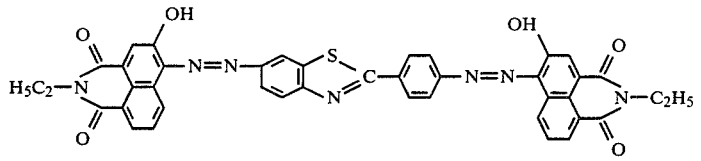
(46)
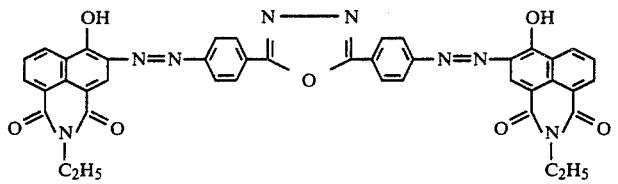
(47)
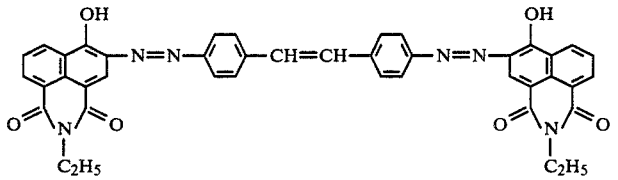
(48)
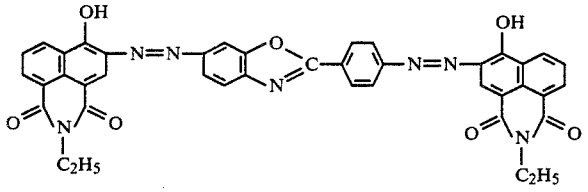
(49)
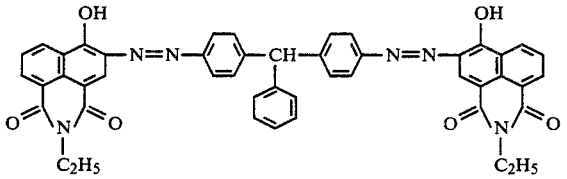
(50)
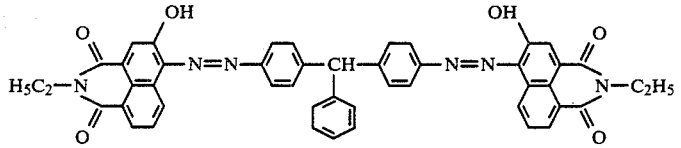
(51)
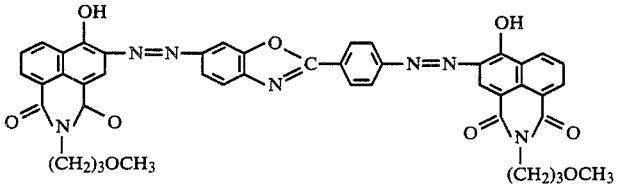
(52)
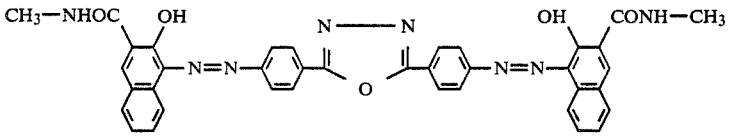
(53)
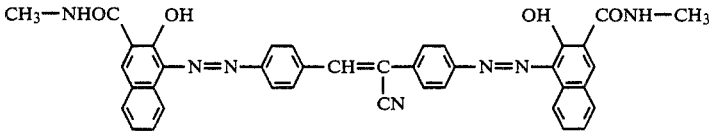

-continued

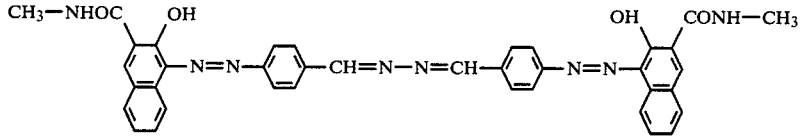

(54)

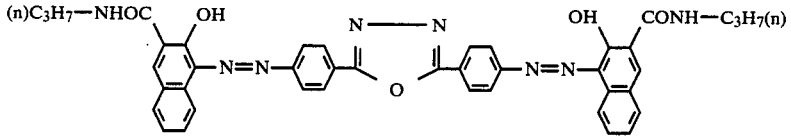

(55)

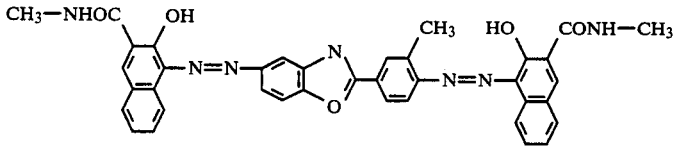

(56)

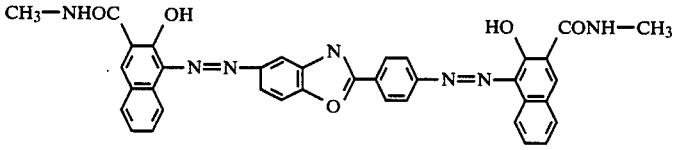

(57)

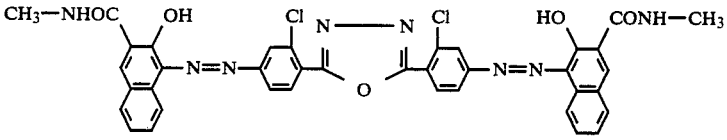

(58)

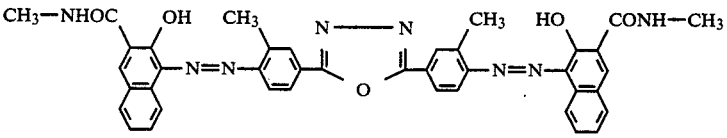

(59)

On the other hand, as the compounds for silylation of azo pigments according to this invention, one may enumerate such generally well-known silylation agents as hexamethyldisilazane, dimethyl dichlorosilane, trimethyl chlorosilane, N-trimethylsilyl acetamide, N,O-bis-(trimethyl silyl) acetamide, N-methyl-N-trimethylsilyl acetamide, N-methyl-N-trimethylsilyltrifluoroacetamide, N-trimethylsilyl dimethylamine, N-trimethylsilyl diethylamine, bis-(trimethylsilyl) trifluoroacetamide, N-trimethylsilyl imidazole, tetramethyl disilazane, trichloro-n-butylsilane, t-butyldimethyl chlorosilane, etc. and such halomethyl silylation agents as dichloromethyl tetramethyl disilazane, chloromethyl dimethyl chlorosilane and bromomethyl dimethyl chlorosilane, etc. These silylation agents may be used alone or in combination. With regard to the process of silylation of azo pigment, a method may be employed, for example, by which an azo pigment is mixed with the silylation agent or a halomethyl silylation agent in a ball mill for several hours. In this case, acetonitrile, pyridine or N,N-dimethylformamide, etc. may be used jointly as a dilution solvent or a hydrochloric acid acceptor.

In the silylation agent, normally hydrolysis, etc. proceeds rapidly and therefore it is used, in terms of parts by weight, 2 to 40 times and preferably, 10 to 20 times the pigment to be treated.

A disazo pigment processed with a silylation agent is used as a charge generation layer, it can be formed on a conductive substrate by dispersing the pigment along with a proper binding agent and coating on the conductive substrate, or it can be obtained by forming a vacuum deposition film with a vacuum deposition apparatus.

As for the binder to be used upon forming a charge generation layer by coating, it can be selected from a wide range of insulating resins, or organic photoconductive polymers such as poly-N-vinylcarbazole, a polyvinyl anthracene and polyvinyl pyrene, and the like. Preferable insulating resins are polyvinyl butyral, polyarylate (condensation polymer of bisphenol A and phthalic acid, etc.), polycarbonate, polyester, phenoxy resin, polyvinyl acetate, acrylic resin, polyacrylamide resin, polyamide, polyvinyl pyridine, cellulose series resin, urethane resin, epoxy resin, casein, polyvinyl alcohol and polyvinyl pyrrolidone, and the like. A suitable resin content in a charge generation layer is not more than 80 weight percents, and preferably, not more than 40 weight percents.

The solvent for dissolving these resins varies depending upon the type of resin, and in addition, it is desirable that the solvent does not dissolve a charge transfer layer and a subbing layer to be mentioned hereinafter.

As the organic solvents, alcohols such as methanol, ethanol, isopropanol, and the like, ketones such as acetone, methylethyl ketone, cyclohexanone,and the like, amides such as N,N-dimethylformamide, N,N-dimethylacetamide, and the like, sulfoxides such as dimethyl sulfoxide, and the like, ethers such as tetrahydrofuran, dioxane, ethylene glycol monomethyl ether, and the like, esters such as methyl acetate, ethyl acetate, and the like, aliphatic hydrocarbon halides such as chloroform, methylene chloride, dichloroethylene, carbon tetrachloride, trichloroethylene, and the like, or aromatic compounds such as benzene, toluene, xylene, ligroin, monochlorobenzene, dichlorobenzene, and the like can be used.

Coating can be performed by applying a coating process such as dip coating, spray coating, spinnner coating, head coating, Mair bar coating, blade coating, roller coating, curtain coating, and the like. For drying a method of drying by heating after set-to-touch at room temperature is preferable. Drying by heating can be performed at temperature of 30° C. to 200° C. for 5 minutes to 2 hours in a stationary condition or under air blow.

A charge transfer layer is connected electrically with the charge generation layer and has a function of receiving charge carriers injected from the charge generation layer in the existence of electric field and transferring these charge carriers to the surface. In this case, the charge transfer layer may be laminated on or beneath the charge generation layer. It is, however, preferable that the charge transfer layer is laminated on the charge generation layer.

Since a photoconductor generally has the function of transferring charge carriers, a charge transfer layer can be made of such photoconductor.

It is preferable that the material in a charge transfer layer that transfers charge carriers (hereinafter briefly called "the charge transfer material") is substantially non-sensitive to the wave range of electromagnetic wave to which the charge generation layer is sensitive. The "electromagnetic wave" as referred to here includes the definition of "ray of light" in a broad sense, comprising γ-ray, X-ray, ultraviolet ray, visible ray, near-infrared ray, infrared ray and far-infrared ray, etc. In cases that the photosensitive wave range of a charge transfer layer coincides with or overlaps that of a charge generation layer, charge carriers generated in the both layers capture each other resulting in lowering of sensitivity.

As the charge transfer material, there are electron transfer materials and hole transfer materials. As the electron transfer material, there are electronattractive materials such as chloranil, bromoanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylene fluorenone, 2,4,5,7-tetranitroxanthone and 2,4,8-trinitrothioxanthone, and the like and high polymers of these electron-attractive materials and the like.

As the hole transfer materials, there are polycyclic aromatics such as naphthalene, anthracene, pyrene, and the like, carbazoles such as N-ethyl carbazole, N-isopropyl carbazole, and the like, hydrazones such as N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N, N-diphenyl hydrazone, p-diethylaminobenzaldehyde-N-α-naphthyl-N-phenylhydrazone, p-pyrrolidinyl benzaldehyde-N,N-diphenylhydrazone, 1,3,3-trimethylindolenine-ω-aldehyde-N, N-diphenylhydrazone, p-diethylbenzaldehyde-3-methylbenzthiazolinone-2-hydrazone, and the like, pyrazolines such as 2,5-bis (p-diethylaminophenyl)-1,3,4-oxadiazole, 1-phenyl-3-(p-diethylaminostyryl)-5-(p-diethyl aminophenyl) pyrazoline, 1-[quinolyl (2)]-3-(p-diethyl aminostyryl)-5-(p-diethyl aminophenyl)pyrazoline, 1-[pyridyl (2)]-3-(p-diethylaminostyryl)-5-(p-diethylaminophenyl) pyrazoline, 1-[6-methoxypyridyl (2)]-3-(p-diethylaminostyryl)-5-(p-diethylaminophenyl) pyrazoline, 1-[pyridyl (3)]-3-(p-diethylaminostyryl)-5-(p-diethylaminophenyl) pyrazoline,1-[lepidyl (2)]-3-(p-diethylaminostyryl)-5-(p-diethylaminophenyl) pyrazoline, 1-[pyridyl (2)]-3-(p-diethylaminostyryl)-4-methyl-5-(p-diethylaminophenyl) pyrazoline, 1-[pyridyl (2)]-3-(α-methyl-p-diethylaminostyryl)-5-(p-diethylaminophenyl) pyrazoline, 1-phenyl-3-(p-diethylaminostyryl)-4-methyl-5-(p-diethylaminophenyl) pyrazoline, 1-phenyl-3-(α-benzyl-p-diethylaminostyryl)-5-(p-diethylaminophenyl) pyrazoline, and spiropyrazoline, and the like, oxazole series compounds such as 2-(p-diethylaminostyryl)-6-diethylaminobenzoxazole, 2-(p-diethylaminophenyl)-4-(p-dimethylaminophenyl)-5-(2-chlorophenyl) oxazole, and the like, thiazole series compounds such as 2-(p-diethylaminostyryl)-6-diethylamino benzthiazole, and the like, triaryl methane series compounds such as bis-(4-diethylamino-2-methylphenyl)-phenyl methane, and the like, polyaryl alkanes such as 1,1-bis-(4-N,N-diethylamino-2-methylphenyl) heptane and 1,1,2,2-tetrakis (4-N,N-dimethylamino-2-methylphenyl) ethane, and the like, triphenyl amine, poly-N-vinyl carbazoles, polyvinyl pyrenes, polyvinyl anthracenes, polyvinyl acridines, poly-9-vinylphenyl anthracenes, pyrene-formaldehyde resin, N-ethyl carbazole formaldehyde resin, and the like.

Besides these organic charge transfer materials, inorganic materials such as selenium, selenium-tellurium, amorphous silicon and cadmium sulfide, and the like can also be employed.

Further, these charge transfer materials may be used alone or in combination.

In case that a charge transfer material does not possess a film-forming property, the film can be formed by using an appropriate binder. The resins usable as the binder are, for instance, insulating resins such as acrylic resin polyarylate, polyester, polycarbonate, polystyrene, acrylonitrile-styrene copolymer, acrylonitrile-butadiene copolymer, polyvinyl butyral, polyvinyl formal, polysulfone, polyacrylamide, polyamide and chlorinated rubber, and the like, or organic photoconductive polymers such as poly-N-vinylcarbazole, polyvinyl anthracene and polyvinyl pyrene, and the like.

Since the charge transfer layer is limited in its capacity to transfer charge carriers, the film thickness can not be made greater than necessary. Generally, a range from 5 microns to 30 microns is acceptable, but a range from 8 microns to 20 microns is preferable. When a charge transfer layer is formed by coating, an appropriate coating method among the abovementioned may be employed.

A photosensitive layer comprising a laminated construction of these charge generation and charge transfer layers is provided on a substrate having a conductive layer. As the substrate having a conductive layer, a substrate that the substrate itself has conductivity such as aluminium, aluminium alloy, copper, zinc, stainless steel, vanadium, molybdenum, chronium, titanium, nickel, indium, gold, platinum, and the like can be used, and further, plastics with a layer formed by vacuum deposition of aluminium, alluminium alloy, indium oxide, tin oxide or indium oxide-tin oxide alloy, etc. (the plastics being, for example, polyethylene, polypropylene, polyvinyl chloride, polyethylene terephthalate, acrylic resin and polyethylene fluoride, etc.), substrates comprising plastics on which conductive particles (such as carbon black and silver particles, etc.) are coated using an appropriate binder, substrates comprising plastics or paper impregnated with conductive particles, and plastics composed of conductive polymer, and the like can be employed.

Between a conductive layer and a photosensitive layer, a subbing layer having a function of barrier and an adhesive property may be provided. The subbing layer may be formed of casein, polyvinyl alcohol, nitrocellulose, ethylene-acrylic acid copolymer, polyamide (nylon 6, nylon 66, nylon 610, copolymer nylon, alkoxy methylated nylon, etc.), polyurethane, gelatin or aluminium oxide, and the like.

The appropriate film thickness of a subbing layer is 0.1 micron to 5 microns, and preferably 0.5 microns to 3 microns.

When a photosensitive member composed of a conductive layer, a charge generation layer and a charge transfer layer laminated in this order is used and the charge transfer material is composed of an electron transfer material, it is necessary to positively charge the surface of the charge transfer layer. Exposure is made after charging, and, at the exposed portion, electrons generated in the charge generation layer are injected into the charge transfer layer and thereafter reach the surface to neutralize positive charges. There is caused attenuation of surface potential, and an electrostatic contrast is produced between the exposed and the non-exposed portions. When electrostatic latent image thus produced is developed with a negative charging toner, a visible image can be obtained. This visible image can be fixed directly, or the toner image can be transferred onto paper or a plastic film, etc., and then fixed.

Further, a method of transferring an electrostatic latent image on the photosensitive member onto the insulation layer of a receiving paper, followed by development and fixing can also be employed. The developer, the developing process and the fixing process may be those of known ones without being limited to any specific ones.

On the other hand, in case that the charge transfer material is composed of a hole transfer material, it is necessary to negatively charge the surface of the charge transfer layer and, when exposure is effected after charging, positive holes generated in the charge generation layer are injected into the charge transfer layer at the exposed portion, reach the surface thereafter and neutralize negative charges, resulting in attenuation of surface potential, and an electrostatic contrast is produced between the exposed and the non-exposed portions. In the case of development, it is necessary to use a positive charge toner, contrary to the case of electron transfer materials.

In the following the present invention will be described in accordance with processing examples and examples as well as comparative examples.

PROCESSING EXAMPLE 1

The aforesaid disazo pigment (No. 5), 5 g, hexamethyldisilazane, 10 g, and acetonitrile, 40 g, were put in a dry ball mill and processed for dispersion. After two hours, revolution was stopped, followed by allowing to stand overnight. After filtering the dispersion solution, the product was washed 5 times with 100 ml of N,N-dimethylformamide and then subjected to drying by heating under reduced pressure to produce 3.8 g of silylated disazo pigment.

PROCESSING EXAMPLE 2

The aforesaid disazo pigment (No. 52), 5 g, trimethyl chlorosilane, 10 g, N,N-dimethylformamide, 40 g and pyridine, 2 g, were put in a dry ball mill and processed for dispersion. After two hours, revolution was stopped, followed by allowing to stand overnight. After filtration of the dispersion solution, the product was washed 5 times with N,N-dimethylformamide. Subsequently, the product was dried by heating under reduced pressure to give 4.2 g of silylated disazo pigment.

PROCESSING EXAMPLE 3

The aforesaid disazo pigment (No. 56), 5 g, hexamethyl disilazane, 2.5 g, trimethyl chlorosilane, 2.5 g, acetonitrile, 40 g, and pyridine, 2 g, were put in a ball mill and processed for dispersion. After two hours, revolution was stopped, followed by allowing to stand overnight. After filtration of the dispersion solution, the product was washed 5 times with N,N-dimethylformamide. By subsequent drying by heating under reduced pressure, 3.9 g of silylated disazo pigment were obtained.

The processes for the 3 types of pigments have been described as above; other disazo pigments also can be processed similar to other silylation agents.

EXAMPLE 1

Ammonia water solution of casein (casein, 11.2 g, 28% ammonia water, 1 g and water, 222 ml) was so coated, with a Mair bar, and on an aluminum plate that film thickness after drying will be 10 microns.

Next, a disazo pigment obtained in Processing Example 2, 3 g, was added to a solution comprising 63 ml of ethanol in which 1.5 g of butyral resin (63 mol % butyralated) was dissolved, and dispersed with attritor for 2 hours. This dispersion solution was so coated, with a Mair bar, and dried on the previously formed casein layer to form a charge generation layer of 0.5 micron thick after drying.

Next, a hydrazone compound, 5 g, having the following structural formula:

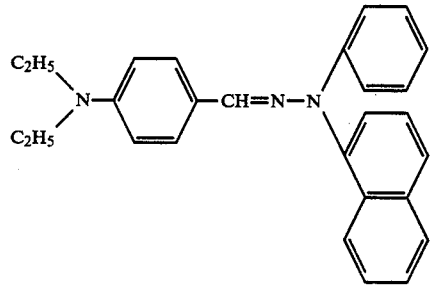

and polymethyl methacrylate resin (number-average molecular weight 100,000) were dissolved in 70 ml of benzene. The resulting mixture was then coated, with a Mair bar, and dried on the charge generation layer so that the film thickness after drying became 12 microns, thus forming a charge transfer layer.

The electrophotographic photosensitive member thus prepared was subjected to corona charging at −5 KV under a static system, using an electrostatic copying paper testing machine, Model SP-428, made by KAWAGUCHI DENKI Co., Ltd., held for 10 seconds at a dark place and exposed with illuminance of 5 luxes and its charge bearing characteristics were examined.

With regard to the charge bearing characteristics, surface potential ($V_o$) and exposure quantity ($E_{\frac{1}{2}}$) for halving potential after 10-second dark attenuation were measured.

Further, in order to measure fluctuations in light area potential and dark area potential upon repeated use, the photosensitive member prepared in this example was applied to the cylinder of the electrophotographic duplicating machine equipped with a −5.6 KV corona charger, an exposure optical system with exposure quantity of 12 lux.sec. a developing device, a transfer charger, a discharging exposure optical system and a cleaner. This duplicating machine is so constructed that, as the cylinder is driven, an image can be obtained on a transfer paper. Using this duplicating machine, initial light area potential ($V_L$) and dark area potential ($V_D$) as well as light area potential ($V_L$) and dark area potential ($V_D$) after 5,000 times of use were measured. The results are shown in the following:

$V_o$: −650 V $E_{\frac{1}{2}}$: 2.3 lux.sec.

-continued

| Initial | After 5,000-times copying |
|---|---|
| $V_L$: −40 V | $V_L$: −120 V |

EXAMPLES 2–9

Electrophotographic photosensitive members were prepared by entirely the same method as Example 1 except that, in place of the disazo pigment used in Example 1, the aforesaid disazo pigments (5), (7), (9), (15), (56), (57), (58) and (59) processed in a manner similar to Processing Example 2 were employed.

The charge bearing characteristics and durability characteristics of each photosensitive member were measured by the method similar to Example 1. The results are shown in the following.

COMPARATIVE EXAMPLES 2–9

The photosensitive members were made by entirely the same methods as Examples 2–9 and similar measurements were made except that, in place of the disazo pigments employed in Examples 2–9, non-silylated disazo pigments (5), (7), (9), (15), (56), (57), (58) and (59) were employed. The results are shown in the following.

| Example No. and Comparative Example No. (Pigment No.) | $V_o$ (Volt) (Value in Comparative Example) | $E_{\frac{1}{2}}$(lux · sec) (Value in Comparative Example) | Initial $V_D$(volt) (Value in Comparative Example) | Initial $V_L$(volt) (Value in Comparative Example) | After 5000-times Copying $V_D$(volt) (Value in Comparative Example) | After 5000-times Copying $V_L$(volt) (Value in Comparative Example) |
|---|---|---|---|---|---|---|
| 2 | −610 | 3.2 | −620 | −30 | −615 | −34 |
| (5) | (−630) | (4.5) | (−630) | (−70) | (−600) | (−180) |
| 3 | −605 | 2.8 | −610 | −20 | −620 | −35 |
| (7) | (−605) | (3.8) | (−610) | (−40) | (−600) | (−180) |
| 4 | −615 | 2.7 | −620 | −15 | −625 | −30 |
| (9) | (−630) | (3.9) | (−630) | (−60) | (−615) | (−160) |
| 5 | −620 | 3.5 | −630 | −10 | −630 | −30 |
| (15) | (−625) | (4.3) | (−615) | (−50) | (−600) | (−170) |
| 6 | −610 | 2.8 | −620 | −15 | −625 | −30 |
| (56) | (−635) | (4.0) | (−620) | (−50) | (−600) | (−160) |
| 7 | −630 | 3.5 | −625 | −20 | −620 | −25 |
| (57) | (−640) | (4.8) | (−620) | (−40) | (−610) | (−155) |
| 8 | −625 | 3.2 | −630 | −15 | −615 | −25 |
| (58) | (−635) | (4.7) | (−620) | (−35) | (−600) | (−185) |
| 9 | −640 | 2.8 | −635 | −30 | −630 | −35 |
| (59) | (−635) | (5.0) | (−650) | (−65) | (−670) | (−185) |

| Initial | After 5,000-times copying |
|---|---|
| $V_D$: −640 V | $V_D$: −620 V |
| $V_L$: −20 V | $V_L$: −50 V |

COMPARATIVE EXAMPLE 1

An electrophotographic photosensitive member was prepared by entirely the same method as that in Example 1 except that a non-silylated disazo pigment (the aforesaid No. 52) was employed in place of the disazo pigment, and the similar measurements were made. The results are shown in the following.

$V_o$: −680 V $E_{\frac{1}{2}}$: 4.5 lux.sec.

| Initial | After 5,000-times copying |
|---|---|
| $V_D$: −650 V | $V_D$: −600 V |

EXAMPLE 10

The coating solution made by dissolving 5 g of 2,4,7-trinitro-9-fluorenone and 5 g of poly-4,4-dihydroxydiphenyl-2,2-propanecarbonate (molecular weight 300,000) in 70 ml of tetrahydrofuran was applied to the charge generation layer prepared in Example 1 and dried so that the coating quantity after drying became 10 g/m$^2$.

With regard to the electrophotographic photosensitive member made in this way, the charging measurement was conducted in the same manner as in Example 1. In this case, the charging polarity was ⊕. The results are shown in the following.

$V_o$: +610 V $E_{\frac{1}{2}}$: 3.8 lux.sec.

| Initial | After 5,000-times copying |
|---|---|
| $V_D$: +620 V | $V_D$: +600 V |

-continued

| Initial | After 5,000-times copying |
|---|---|
| $V_L$: +45 V | $V_L$: 50 V |

COMPARATIVE EXAMPLE 10

A photosensitive member was prepared by the same method as that of Example 10 and similar measurements were made except that, in place of the disazo pigment used in Example 10, a non-silylated disazo pigment (No. 52) was employed. The results are shown in the following.

$V_o$: +630 V $E_{\frac{1}{2}}$: 5.2 lux.sec.

| Initial | After 5,000-times copying |
|---|---|
| $V_D$: +635 V | $V_D$: +600 V |
| $V_L$: +55 V | $V_L$: +165 V |

EXAMPLE 11

On the aluminium surface of an aluminium-deposited polyethylene terephthalate film was formed a film of polyvinyl alcohol with film thickness of 1.1 micron.

Next, the disazo pigment dispersion solution used in Example 1 was coated, with a Mair bar, on the previously formed polyvinyl alcohol layer so that film thickness after drying became 0.5 microns, and dried to form a charge generation layer.

Next, the solution comprising 5 g of pyrazoline compound with the following structural formula:

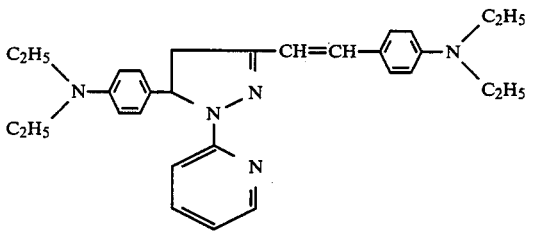

and 5 g of polyarylate resin (condensation polymer of bisphenol A and terephthalic acid-isophthalic acid) as dissolved in 70 ml of tetrahydrofuran was coated on the charge generation layer so that film thickness after drying became 10 microns and dried to form a charge transfer layer.

The charge bearing characteristics and durability characteristics of the photosensitive member thus made were measured in a manner similar to Example 1. The results are shown in the following.

$V_D$: −615 V $E_{\frac{1}{2}}$: 3.2 lux.sec.

| Initial | After 5,000-times copying |
|---|---|
| $V_D$: −610 V | $V_D$: −595 V |
| $V_L$: −15 V | $V_L$: −30 V |

COMPARATIVE EXAMPLE 11

The photosensitive member was made by entirely the same method as Example 11 and similar measurements were made except that, in place of the disazo pigment used in Example 11, the non-silylated disazo pigment (No. 52) was employed. The results are shown in the following.

$V_D$: −630 V $E_{\frac{1}{2}}$: 4.5 lux.sec.

| Initial | After 5,000-times copying |
|---|---|
| $V_D$: −625 V | $V_D$: −605 V |
| $V_L$: −45 V | $V_L$: −165 V |

EXAMPLE 12

With regard to the dispersion solutions used in Example 1 and the Comparative Example 1, the particle size distribution was compared by using a size distribution measuring instrument (CAPA-500, made by HORIBA SEISAKUSHO, Ltd.). The results are shown in the following.

| | Average particle size |
|---|---|
| Example 1 dispersion solution (disazo pigment, silylated) | 0.4 microns |
| Comparative Example 1 dispersion solution (disazo pigment, non-silylated) | 1.8 microns |

What is claimed is:

1. Photoconductive film which comprises a photoconductive pigment obtained by silylation of an azo series pigment having at least one hydroxy group.

2. Photoconductive film of claim 1 wherein the said azo series of pigment is a pigment having a coupler component having at least one phenolic hydroxy group.

3. Photoconductive film of claim 2 wherein the coupler component having a phenolic hydroxy group is hydroxynaphthoic acid amide type of coupler component, hydroxynaphthalic acid imide type of coupler component, or a aminonaphthol type of coupler component.

4. Photoconductive film of claim 4 wherein the hydroxynaphthoic acid amide type of coupler component is expressed by the following general formula:

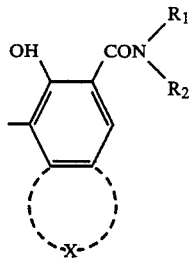

(1)

wherein $R_1$ represents hydrogen atom, substituted or unsubstituted alkyl group, substituted or unsubstituted aryl group, or substituted or unsubstituted aralkyl group and $R_2$ represents alkyl group, aryl group, aralkyl group or heterocycle group that may be substituted, respectively; X represents atomic group required to form aromatic hydrocarbon ring or heterocyclic ring in condensation with benzene ring.

5. Photoconductive film of claim 3 wherein the hydroxynaphthalic acid imide type of coupler component is expressed by the following general formula (2) or (3):

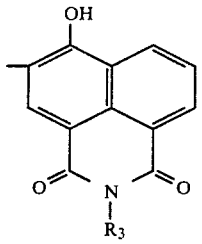

(2)

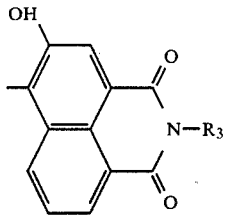

(3)

wherein $R_3$ is alkyl group, aryl group, or aralkyl group that may be substituted, respectively.

6. Photoconductive film of claim 3 wherein the said aminonaphthol type of coupler component is expressed by the following general formula (4):

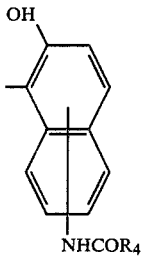

(4)

wherein $R_4$ is alkyl group, aryl group or aralkyl group that may be substituted, respectively.

7. Photoconductive film of claim 1 wherein the said azo series of pigment is disazo series of pigment or trisazo series of pigment.

8. Electrophotographic photosensitive member which comprises a conductive substrate and a photosensitive layer containing photoconductive an azo series pigment obtained by silylation of pigment having at least one hydroxy group.

9. Electrophotographic photosensitive member of claim 8 wherein the azo series of pigment is a pigment with coupler component having at least one phenolic hydroxy group.

10. Electrophotographic photosensitive member of claim 9 wherein the azo series of pigment is disazo series of pigment or trisazo series of pigment.

11. Electrophotographic photosensitive member of claim 8 wherein the silylation is effected by at least one type of compound selected from the group consisting of a silylation agent and a halomethyl silylation agent.

12. Electrophotographic photosensitive member which comprises a conductive substrate, a charge generation layer containing photoconcuctive an azo series pigment obtained by silylation of pigment having at least one hydroxy group, and a charge transfer layer.

13. Electrophotographic photosensitive member of claim 12 wherein the azo series of pigment is a pigment having coupler component having at least one phenolic hydroxy group.

14. Electrophotographic photosensitive member of claim 12 the azo series of pigment is disazo series of pigment or trisazo series of pigment.

15. Electrophotographic photosensitive member of claim 12, wherein the silylation is effected by at least one type of compound selected from the group consisting of a silylation agent and a halomethyl silylation agent.

16. Electrophotographic photosensitive member of claim 12 wherein the charge transfer layer is laminated on the said charge generation layer.

17. Electrophotographic photosensitive member of claim 12 wherein the charge transfer layer contains a charge transfer material and a binder.

18. Electrophotographic photosensitive member of claim 17 wherein the charge transfer material is an electron transfer material or positive hole transfer material.

19. Electrophotographic photosensitive member of claim 18 wherein the positive hole transfer material is at least one type of compound selected from group consisting of polycyclic aromatic compounds, carbazoles, hydrazones, pyrazolines, oxazoles, thiazoles, triaryl methanes, polyaryl alkanes, triphenyl amines, poly-N-vinylcarbazoles, polyvinyl pyrenes, polyvinyl anthracenes, polyvinyl acridines, poly-9-vinylphenyl anthracenes, pyrene-formaldehyde resins and N-ethylcarbazole-formaldehyde resins.

20. Electrophotographic photosensitive member of claim 18 wherein the said positive hole transfer material is hydrazones.

* * * * *

UNITED STATES PATENT AND TRADEMARK OFFICE

CERTIFICATE OF CORRECTION

PATENT NO. : 4,571,369

DATED : February 18, 1986

INVENTOR(S) : MASATAKA YAMASHITA

It is certified that error appears in the above-identified patent and that said Letters Patent is hereby corrected as shown below:

COLUMN 19

Line 46, "electronattractive" should read --electron-attractive--.

COLUMN 26

Line 42, "claim 4" should read --claim 3--.

COLUMN 27

Lines 40-41, "photoconductive an azo series/ pigment obtained by silylation of pigment" should read --photoconductive pigment obtained by silylation of an azo series pigment--.

UNITED STATES PATENT AND TRADEMARK OFFICE

CERTIFICATE OF CORRECTION

PATENT NO. : 4,571,369

DATED : February 18, 1986 Page 2 of 2

INVENTOR(S) : MASATAKA YAMASHITA

It is certified that error appears in the above-identified patent and that said Letters Patent is hereby corrected as shown below:

COLUMN 28

Lines 10-11, "photoconcuctive an azo series pigment obtained by silylation of pigment" should read --photoconductive pigment obtained by silylation of an azo series pigment--.

Line 18, "12 the" should read --12 wherein the--.

Signed and Sealed this

Seventh Day of April, 1987

*Attest:*

*Attesting Officer*

DONALD J. QUIGG

*Commissioner of Patents and Trademarks*